US008348092B1

(12) United States Patent
Lopez-Torres, Jr.

(10) Patent No.: US 8,348,092 B1
(45) Date of Patent: Jan. 8, 2013

(54) RECYCLING BIN COVER

(76) Inventor: Augusto Lopez-Torres, Jr., Orlando, FL (US)

( * ) Notice: Subject to any disclaimer, the term of this patent is extended or adjusted under 35 U.S.C. 154(b) by 962 days.

(21) Appl. No.: 12/245,980

(22) Filed: Oct. 6, 2008

(51) Int. Cl.
*B65D 45/16* (2006.01)

(52) U.S. Cl. ..... 220/758; 220/324; 220/908; 220/9.1; 220/287; 220/755; 220/774

(58) Field of Classification Search ..... 220/324, 220/908, 9.1, 9.2, 9.3, 287, 755, 758, 774, 220/305; 150/159
See application file for complete search history.

(56) References Cited

U.S. PATENT DOCUMENTS 5,335,805 A * 8/1994 Chen ..... 220/668
5,490,594 A * 2/1996 Rupe ..... 206/315.4
5,904,195 A * 5/1999 Doig ..... 150/159
6,230,920 B1 * 5/2001 Porter ..... 220/319
6,283,290 B1 * 9/2001 Thompson ..... 206/315.4
6,405,409 B1 * 6/2002 Zirella ..... 16/421

* cited by examiner

*Primary Examiner* — Anthony Stashick
*Assistant Examiner* — Christopher McKinley
(74) *Attorney, Agent, or Firm* — Allen, Dyer, Doppelt, Milbrath & Gilchrist, P.A.

(57) ABSTRACT

The invention discloses a recycling bin cover comprising a base member engageable with a periphery of a recycling bin's open top; a frame having a plurality of frame members extending upwardly from the base member toward an imaginary apex; a curtain supported on and forming a sidewall extending around the frame; a flap forming an openable sidewall in the curtain; an opening positioned on the curtain and dimensioned to accept materials for recycling into the bin; and one or more lifting members connected to the base member, to the frame, or to both, and extending to form a handle above the recycling bin cover. Also included is a method of advertising by displaying a collegiate or sports emblem on the recycling bin cover disclosed.

20 Claims, 6 Drawing Sheets

RECYCLING BIN COVER

FIELD OF THE INVENTION

The present invention relates to the field of recycling bins and, more particularly, to a cover for a recycling bin.

BACKGROUND OF THE INVENTION

As our country and our cities have become more and more populous, waste recycling has increased in importance and has become more popular with the environmentally conscious. Waste recycling, particularly, plastics, glass, metals, especially aluminum, and paper helps conserve our natural resources and greatly reduces unnecessary input to landfills which are quickly becoming saturated. For those reasons, more municipalities are encouraging their citizens to recycle such materials. Most communities which promote recycling will distribute standardized bins to every household and request that these bins be used for depositing the materials for recycling. On scheduled days, the full bins will be placed at curbside for waste management personnel to pick up. Often, bins may be overly full and newspapers and other materials may fall out or be blown out of the bin and into the street. Additionally, it is difficult for the user to properly contain materials in an overfilled bin.

SUMMARY OF THE INVENTION

With the foregoing in mind, the present invention advantageously provides a cover for a recycling bin. A typical recycling bin as used in the United States is a generally rectangular container which is slightly tapered from its base outwardly toward its mouth, so that the base of the container is a bit smaller in perimeter than the container's mouth. Additionally, the typical recycling bin has a lip around the periphery of the mouth of the container, the lip being shaped generally as an upside down "J" or gutter so that the user may lift the bin by engaging the fingertips under the lip.

Accordingly, in one preferred embodiment, the present invention discloses a recycling bin cover comprising a base member engageable with a periphery of a recycling bin's open top. A frame has a plurality of frame members extending upwardly from the base member toward an imaginary apex. A curtain is supported on and forms a sidewall extending around the frame. A flap forms an openable sidewall in the curtain. An opening is positioned on the curtain and dimensioned to accept materials for recycling into the bin. One or more lifting members are connected to the base member, to the frame, or to both, and extending to form a handle above the recycling bin cover.

BRIEF DESCRIPTION OF THE DRAWINGS

Some of the features, advantages, and benefits of the present invention having been stated, others will become apparent as the description proceeds when taken in conjunction with the accompanying drawings, presented solely for exemplary purposes and not with intent to limit the invention thereto, and in which.

DETAILED DESCRIPTION OF THE PREFERRED EMBODIMENT

The present invention will now be described more fully hereinafter with reference to the accompanying drawings, in which preferred embodiments of the invention are shown. Unless otherwise defined, technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. Any publications, patent applications, patents, and other references mentioned herein are incorporated by reference in their entirety. In case of conflict, the present specification, including any definitions, will control. In addition, the materials, methods and examples given are illustrative in nature only and not intended to be limiting. Accordingly, this invention may be embodied in many different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description, and from the claims.

FIGS. 1 through 6 illustrate a recycling bin cover 10 according to an embodiment of the present invention. As shown in the figures, a base member 12 is engageable with a periphery of the recycling bin's (B) open top. The typical recycling bin B has a lip L all about the periphery of the open top and this lip serves for the user to grasp the bin with the fingertips. In the present invention, the base member 12 engages with or sits on the bin's lip L to help secure the cover 10 to the bin. The skilled will understand that the base member 12 may take forms other than the one illustrated in FIGS. 1-6. For example, base member 12 may be a substantially rectangular frame into which the recycling bin may be introduced, the base member frame sliding up along the sides of the recycling bin until it engages under the peripheral lip at the rim of the open top of the bin. Additionally, other variations on the physical structure of the base member 12 which engages the lip of the recycling bin are also contemplated as being included in the present invention and will come to the mind of those skilled in the art. For example, the base member 12 may engage with the recycling bin's lip by use of hooks, snaps, toggles, or any other known structural device that grabs onto the lip of the bin.

Figure 1:
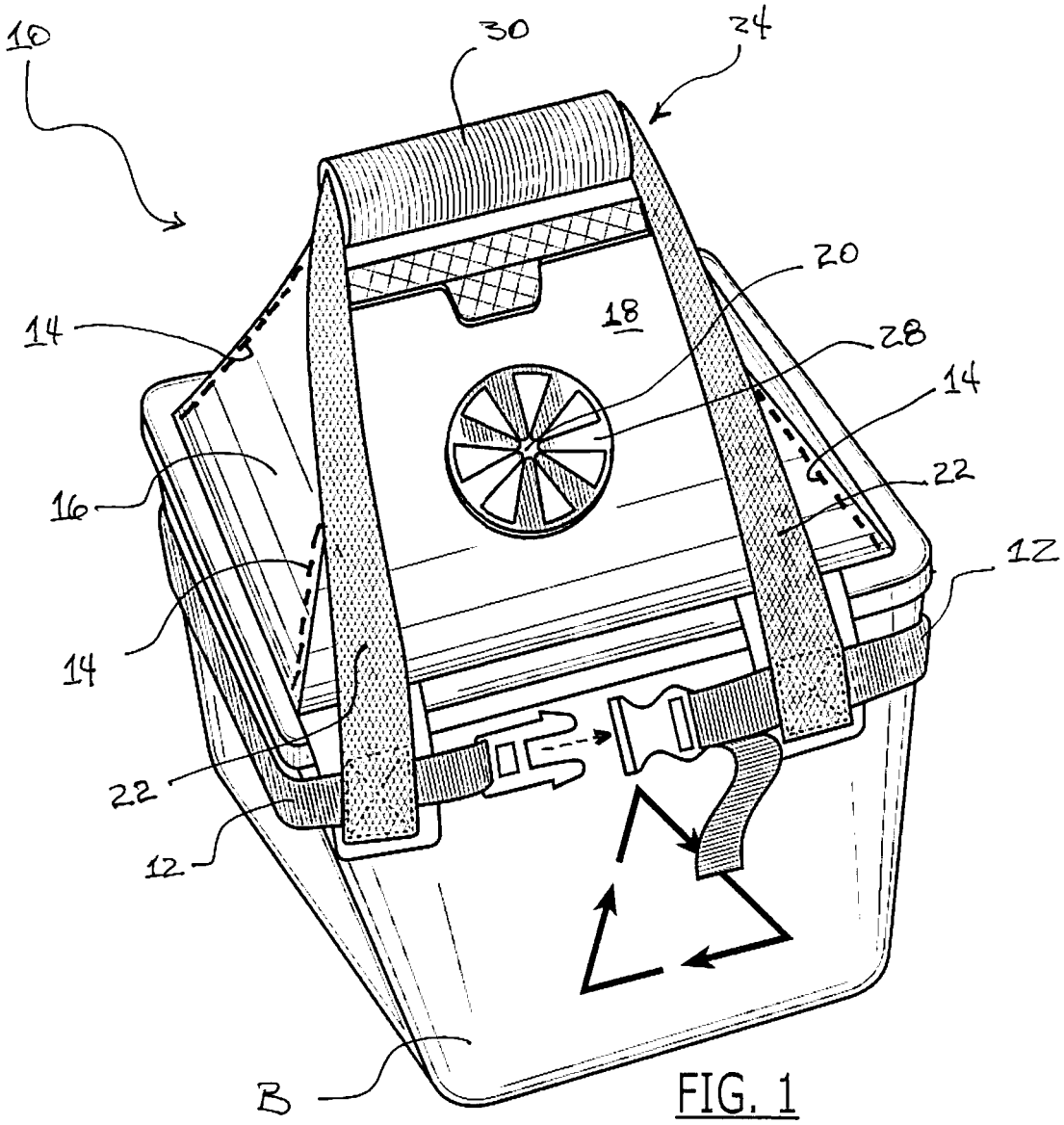
FIG. 1 is a front perspective view of the present cover positioned on a typical recycling bin according to an embodiment of the present invention.
Figure 2:
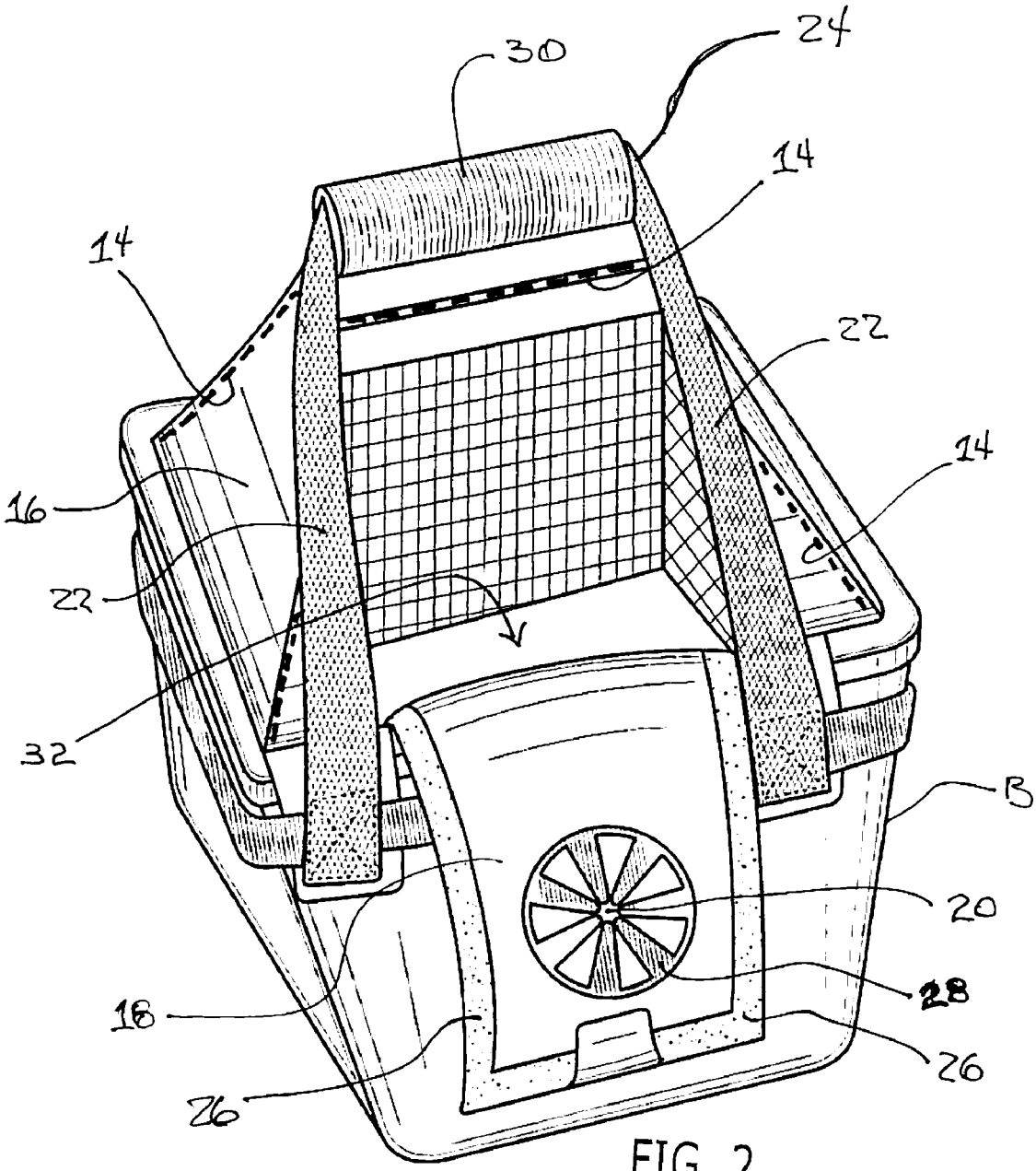
FIG. 2 illustrates the opening having an openable flap thereon, so as to provide access to the interior of the recycling bin.
Figure 4:
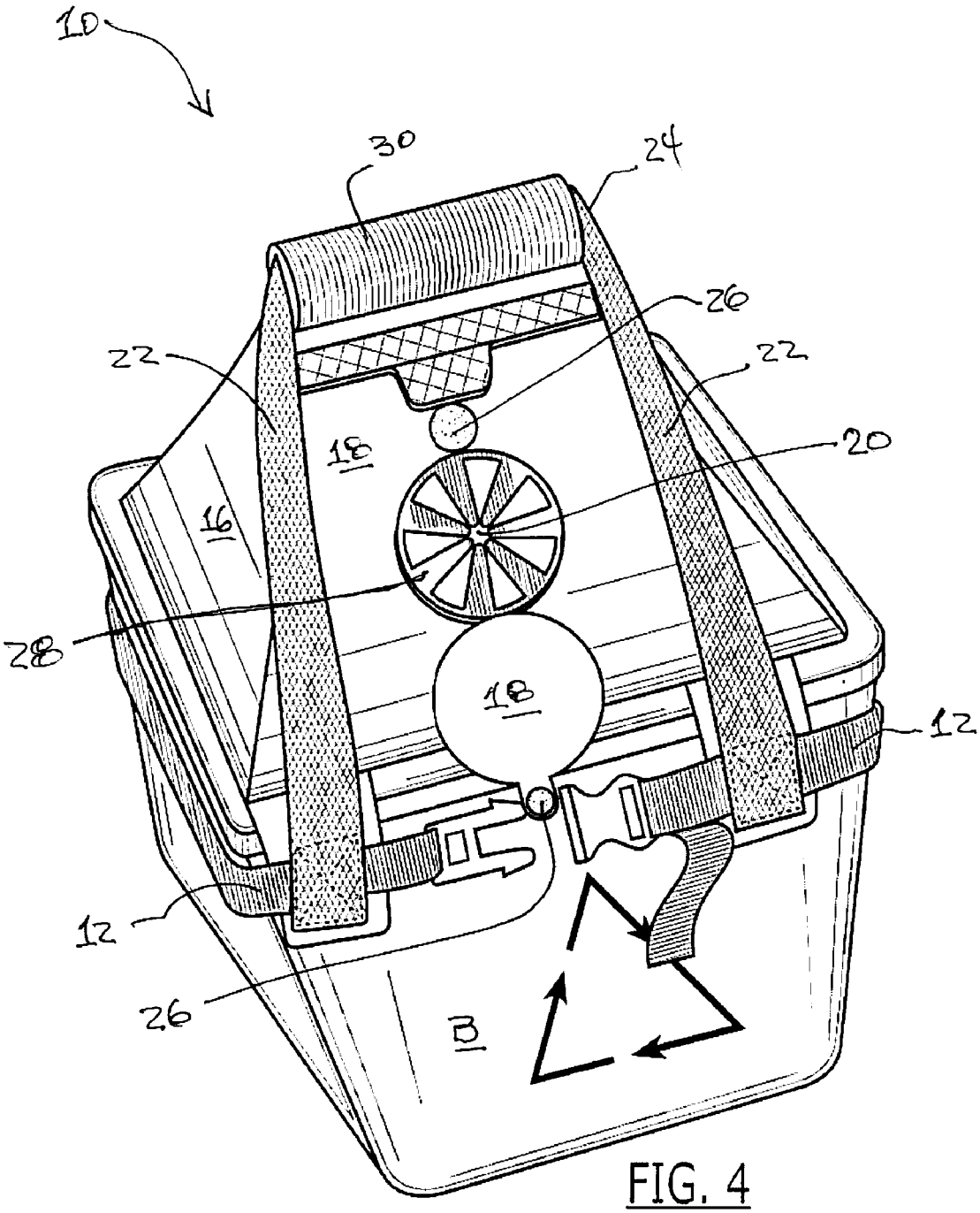
FIG. 4 shows an additional embodiment of the recycling bin cover of FIG. 1 having an openable flap as a closure over the opening.

A frame has a plurality of frame members 14 (shown in dashed lines) extending upwardly from the base member 12 toward an imaginary apex. The frame members 14 provide support for a curtain 16 which forms a sidewall extending around the frame. The frame members 14 could be made of wire, for example, but could be made of any other suitable material. A flap 18 forms an openable sidewall in the curtain 16, as shown in FIGS. 2 and 4. In the embodiment of FIG. 2, the openable flap 18 is almost an entire wall of curtain 16 and can be opened to empty the bin B, for example, or to deposit larger materials in the bin. In FIG. 4, the flap 18 is shown providing a closure for an opening 20 which is preferably dimensioned to receive cans, bottles and like items in the recycling bin. One or more lifting members 22 are connected to the base member 12, to the frame members 14, or to both, and extend to form a handle 24 above the recycling bin cover 10.

Additional optional features of the present recycling bin cover 10 include the base member 12 comprising one or more adjustable straps. As shown in FIGS. 1-6, the adjustable strap and quick-connect buckle are base member 12 disposed so that when the cover 10 engages the bin B, the adjustable strap base member is below the rim lip L of the bin. As the strap buckle is connected and the strap is tightened, the strap engages the bin and is caught under and cannot slip past the rim's lip, thus securely fastening the cover to the recycling bin.

Moreover, the plurality of frame members 14 may be substantially rigid and define a generally pyramidal form, as seen in the figures. Nevertheless, those of skill in the art will recognize that the general shape of the recycling bin cover may be varied within the scope of the invention and does not necessarily need to be pyramidal. The recycling bin cover curtain 16 preferably comprises a generally flexible synthetic material, for example, a resilient, tear resistant and weather resistant synthetic fabric for durability.

In an embodiment of the disclosed recycling bin cover 10, the flap 18 secures in closed position to the curtain by one or more closures 26. These closures 26 are preferably hook and loop closures, for example, the well known Velcro® brand closures. The skilled will understand that, while a hook and loop closure may be preferred, closures useful in the invention would include magnets, zippers, snaps and any other closure known in the art. The opening 20 dimensioned for cans and bottles may comprise a diaphragm 28 which substantially closes the opening when not in use.

For carrying the recycling bin B, the present cover 10 is disposed with one or more lifting members 22 that comprise straps. The handle 24 further comprises a handle cover 30 which secures the one or more lifting members 22 together. Preferably, the handle cover 30 includes a hook and loop closure. Additionally, in a preferred embodiment, the handle 24 is off-center relative to the bin B when in its bin carrying position. Having handle 24 off-center aids a user in carrying the bin B; when the user properly holds the off-center handle, the bin has less tendency to hit the person's leg as it is being carried. Preferred straps for use in the lifting members 22 or handles 24 are load-bearing straps of the type commonly used for luggage and duffel bags.

Another preferred embodiment of the invention includes one or more fastening members 12 (also referred to herein as a base member) effective for fastening the cover 10 to the peripheral lip L of the recycling bin B. A relatively flexible enclosure 16 is connected to the one or more fastening members 12 and covers the open end of the recycling bin B, the enclosure extending above the rim of the recycling bin so as to provide additional storage capacity for the recycling bin B. A first opening 32 is positioned on the enclosure having thereon a flap 18 closure. A second opening 20 in the enclosure is preferably dimensioned for receiving cans and bottles into the bin. One or more handles 24 are supported by the one or more fastening members and extend upwardly therefrom toward a common point above the recycling bin cover 10.

Optional features of this embodiment of the invention are similar to those noted above, for example, the one or more fastening members comprise one or more adjustable straps. The relatively flexible enclosure 16 (also referred to as the curtain) comprises a synthetic material, preferably a woven, synthetic fabric which is tear resistant and weather resistant. Other optional features include the flap 18 securing in closed position to close the first opening 36 by one or more closures 26, particularly by hook and loop closures as noted above. The second opening 20 comprises a diaphragm 28 substantially closing the opening when not in use. In the cover 10, the one or more handles 24 comprise straps.

Yet another embodiment of the present invention includes a recycling bin cover which has all the features of those described above, but where the base member 12 provides a floor upon which the entire recycling bin rests. The bin cover, then, essentially functions as an outer container in which the recycling bin may be housed and carried. In this embodiment, base member 12 does not engage the rim lip of the recycling bin but has the entire recycling bin resting on the base member. This embodiment is not shown in FIGS. 1-6; it is believed that those of skill in the art will have no difficulty visualizing this variation of the invention from its description herein.

Figure 3:
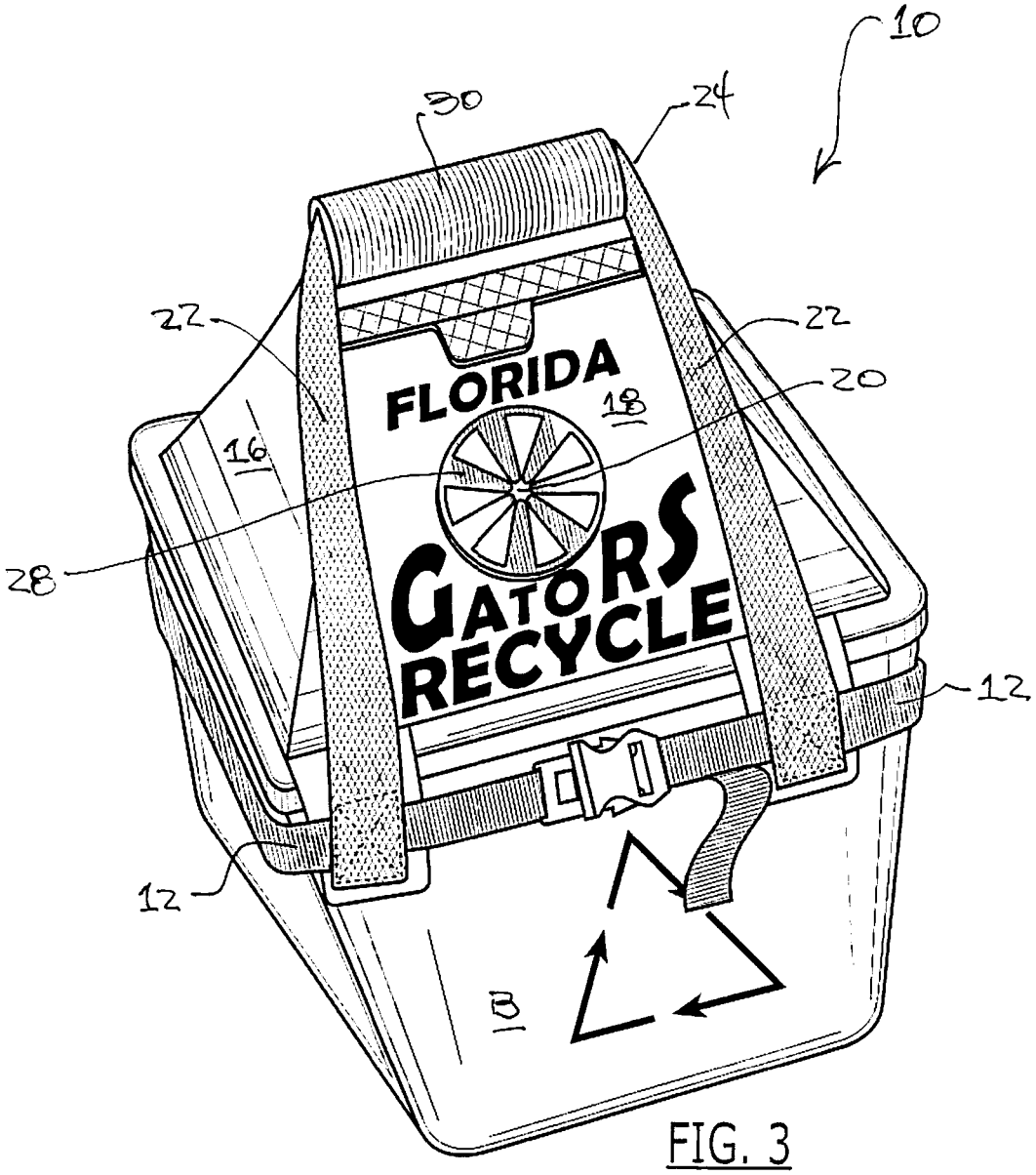
FIG. 3 shows the cover-recycling bin combination of FIG. 1, wherein the opening having a diaphragm is positioned on the openable flap; additionally, the cover of the present invention is shown bearing a collegiate slogan encouraging recycling.
Figure 5:
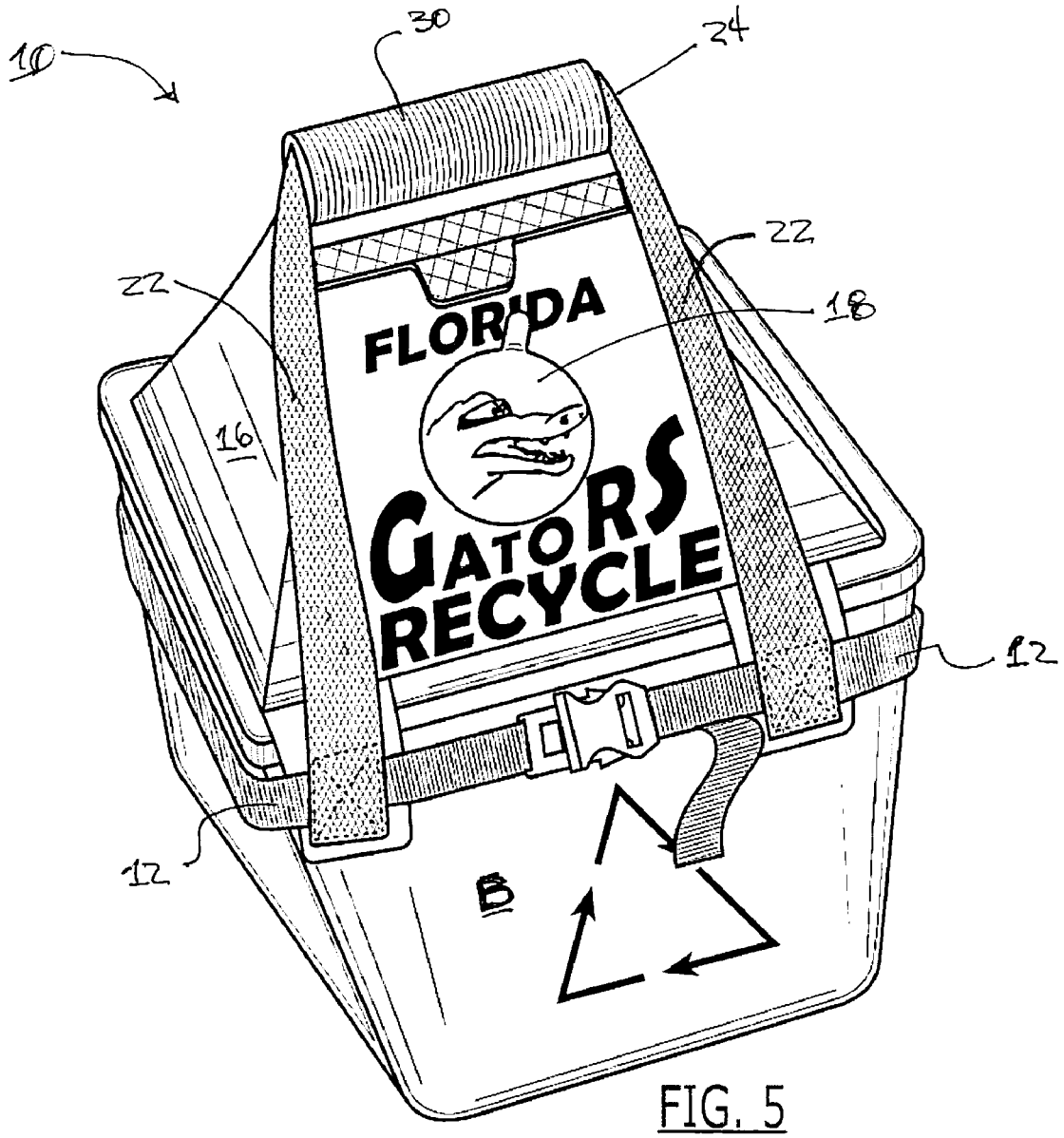
FIG. 5 depicts the recycling bin cover of FIG. 4, wherein a collegiate logo appears on the openable flap.
Figure 6:
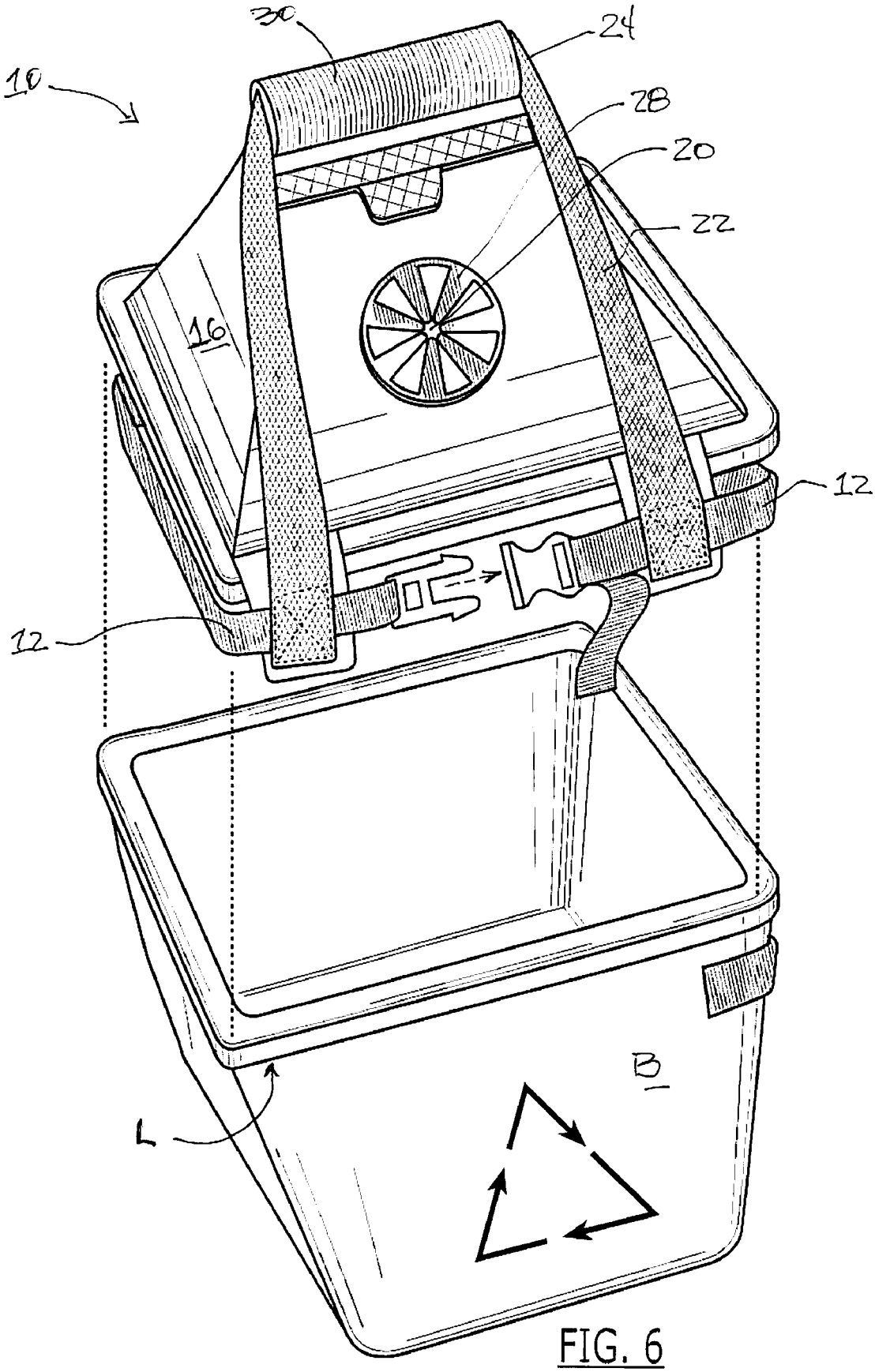
FIG. 6 provides an exploded view showing how the cover engages with a typical recycling bin for use.

The present invention also includes a method of advertising, comprising displaying a trademark or slogan and, most preferably, a collegiate or sports emblem on the recycling bin cover, as shown in FIGS. 3 and 5. Display of a favorite team's logo is intended to encourage its fans to recycle and to promote an image of the team and/or associated university as being good environmental stewards.

Those skilled in the art will appreciate that the presently disclosed invention renders a number of useful functions. The invention closes the open end of a typical recycling bin so as to prevent accidental spillage of the contents and to avoid the unsightly view of accumulated trash. The invention provides the recycling bin with additional storage capacity for trash, as it extends the storage area above the rim of the recycling bin. The invention also provides a secure engagement with the recycling bin and a handle for a user to carry a full bin out to curbside for pickup. The invention additionally serves as a display platform for a corporate trademark or slogan, or for a collegiate or sports team logo, encouraging people to be environmentally conscious consumers and fans. The invention also helps prevent recycling trash from being blown out of the bin when at curbside, for example, old newspapers which are often piled on top of the cans and glass items for recycling. The present cover helps keep out the elements, such as rain and snow, leaves and twigs that may be blown about, and also helps prevent animals from rummaging through the recyclables.

Accordingly, in the drawings and specification there have been disclosed typical preferred embodiments of the invention and although specific terms may have been employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A recycling bin cover comprising:

a base member engageable with a periphery of a recycling bin;

a plurality of frame members forming a frame extending upwardly from said base member toward an imaginary apex;

a curtain supported on and forming a sidewall extending around said frame;

a flap forming an openable sidewall in said curtain;

an opening positioned on said curtain and dimensioned to accept materials for recycling into the bin; and one or more lifting members connected to said base member, to said frame, or to both, and extending to form a handle above said base member, said handle being spaced apart from said curtain and arranged to be laterally off-centered relative to a center of the recycling bin when the base member is engaged with the bin such that, when said handle is in a recycling bin carrying position, the laterally off-centered arrangement reduces interference between the recycling bin and a users leg.

2. The recycling bin cover of claim 1, wherein the periphery of the recycling bin comprises an open top of the bin.

3. The recycling bin cover of claim 1, wherein the periphery of the recycling bin comprises the base of the bin and the entire bin is housed within said cover.

4. The recycling bin cover of claim 1, wherein said base member comprises one or more adjustable straps.

5. The recycling bin cover of claim 1, wherein said plurality of frame members are substantially rigid and define a generally pyramidal form.

6. The recycling bin cover of claim 1, wherein said curtain comprises a flexible synthetic material.

7. The recycling bin cover of claim 1, wherein said flap secures in closed position to said curtain by one or more closures.

8. The recycling bin cover of claim 1, wherein said flap secures in closed position to said curtain by one or more hook and loop closures.

9. The recycling bin cover of claim 1, wherein said opening comprises a diaphragm which substantially closes the opening when not in use.

10. The recycling bin cover of claim 1, wherein said one or more lifting members comprise straps.

11. The recycling bin cover of claim 1, wherein the handle formed further comprises a handle cover which secures the one or more lifting members together.

12. The recycling bin cover of claim 11, wherein the handle cover includes a hook and loop closure.

13. A cover for a recycling bin having a lip extending peripherally about a rim of the bin's open end, said cover comprising:

one or more fastening members effective for fastening the cover to the peripheral lip of a recycling bin;

an enclosure connected to said one or more fastening members and positionable to cover the open end of the recycling bin, the enclosure being extendable above the rim of the recycling bin so as to provide additional storage capacity;

a first opening in said enclosure having thereon a flap closure;

a second opening in said enclosure dimensioned for receiving containers into the bin; and one or more handles supported by said one or more fastening members and extending upwardly therefrom toward a common point above said fastening members, said one or more handles being spaced apart from said enclosure and arranged to be laterally off-centered relative to a center of the recycling bin when the cover is fastened to the bin such that, when said one or more handles are in a recycling bin carrying position, the laterally off-centered arrangement reduces interference between the recycling bin and a users leg.

14. The cover of claim 13, wherein said one or more fastening members comprise one or more adjustable straps.

15. The cover of claim 13, wherein said flexible enclosure comprises a synthetic material.

16. The cover of claim 13, wherein the flap secures in closed position to close said first opening by one or more closures.

17. The cover of claim 13, wherein the flap secures in closed position to close said first opening by one or more hook and loop closures.

18. The cover of claim 13, wherein said second opening comprises a diaphragm substantially closing the opening when not in use.

19. A cover for a waste bin having a lip extending peripherally about a rim of the bin's open end, said cover comprising:

one or more fastening members effective for fastening the cover to the peripheral lip of a waste bin;

an enclosure connected to said one or more fastening members and positionable to cover the open end of the waste bin, the enclosure being extendable above the rim of the waste bin so as to provide additional storage capacity thereto;

an opening in said enclosure having thereon a flap closure; and one or more handles supported by said one or more fastening members and extending upwardly therefrom toward a common point above said fastening members, said one or more handles being arranged to be laterally off-centered relative to a center of the waste bin when the cover is fastened to the waste bin such that, when said one or more handles are in a waste bin carrying position, the laterally off-centered arrangement reduces interference between the waste bin and a users leg.

20. The cover of claim 19, wherein said one or more handles include an elongated direction and a center of the one or more handles along the elongated direction is arranged to be laterally spaced apart from a center of the bin's open end when said one or more handles are in a waste bin carrying position.

* * * * *